US006860836B1

(12) United States Patent
Wu

(10) Patent No.: US 6,860,836 B1
(45) Date of Patent: Mar. 1, 2005

(54) ROCK CLIMBING EXERCISER FOR INDOOR USE

(76) Inventor: Yu Feng Wu, No. 133, Anhe Rd., Taichung City (TW)

( * ) Notice: Subject to any disclaimer, the term of this patent is extended or adjusted under 35 U.S.C. 154(b) by 0 days.

(21) Appl. No.: 10/755,295

(22) Filed: Jan. 13, 2004

(51) Int. Cl.[7] ..... A63B 7/00; B65G 17/06
(52) U.S. Cl. ..... 482/37; 482/51; 198/850
(58) Field of Search ..... 482/35–37, 1–8, 482/51, 57; 198/850

(56) References Cited

U.S. PATENT DOCUMENTS 3,592,466 A * 7/1971 Parsons ..... 482/53
4,848,737 A * 7/1989 Ehrenfield ..... 482/52
4,923,191 A * 5/1990 Persico ..... 482/52
5,125,877 A * 6/1992 Brewer ..... 482/7
5,549,195 A * 8/1996 Aulagner et al. ..... 198/850
5,919,117 A * 7/1999 Thompson et al. ..... 482/37
6,231,482 B1 * 5/2001 Thompson ..... 482/37

* cited by examiner

*Primary Examiner*—Stephen R. Crow
(74) *Attorney, Agent, or Firm*—Rosenberg, Klein & Lee

(57) ABSTRACT

A rock climbing exerciser includes a main frame having a base member abutting against a support surface and two stands upwardly perpendicularly extending from the base member. The two stands are parallel to each other. A cyclic device is mounted between the two stands. The cyclic device includes a first drive and a second drive device synchronously operated with each other. An endless strap is mounted around the first drive device and second drive device. Multiple grips extend through the endless strap and are secured on the cyclic device for user to climb thereon. A speed reducer is mounted on one of the two stands and connected to the second drive device to reducing the moving speed of the endless strap during operating.

6 Claims, 13 Drawing Sheets

ROCK CLIMBING EXERCISER FOR INDOOR USE

BACKGROUND OF THE INVENTION

1. Field of the Invention

The present invention relates to an exerciser, and more particularly to a rock climbing exerciser for indoor use.

2. Description of Related Art

Nowadays, a rock climbing activity is popular. However, a natural steep is hard to be sought and to climb a natural steep is dangerous to a man who is not very skilled. Consequently, some artificial steeps are assembled. However, an artificial steep needs a great space and is expensive. Consequently, some rock climbing exercisers are marketed.

A conventional rock climbing exerciser comprises continuous panels combined to form an endless climbing wall apparatus that is movably mounted to a stand frame and connected to a speed reducer. The user can simulate a rock climbing sport on the climbing wall apparatus. The structure of the climbing wall apparatus is similar to that of a track link of a tank. Consequently, a gap is formed between two adjacent panels when the climbing wall apparatus is turned. The gap may clamp the user's hair, fingers and clothes. The track-link-like structure contains potential danger when used to a rock climbing exerciser.

In addition, for loading the gravity from the user and preventing the panels from being transformed, the panel of the conventional rock climbing exerciser is made of metal and has a certain thickness so that the total weight of the conventional rock climbing exerciser is great. Consequently, the conventional rock climbing exerciser cannot be widely popularized to every family.

The present invention has arisen to mitigate and/or obviate the disadvantages of the conventional rock climbing exerciser.

SUMMARY OF THE INVENTION

The main objective of the present invention is to provide an improved rock climbing exerciser that can be widely used indoors.

To achieve the objective, the rock climbing exerciser in accordance with the present invention comprises a main frame having a base member abutting against a support surface and two stands upwardly perpendicularly extending from the base member. The two stands are parallel to each other. A cyclic device is mounted between the two stands. The cyclic device includes a first drive and a second drive device synchronously operated with each other. An endless strap is mounted around the first drive device and second drive device. Multiple grips extend through the endless strap and are secured on the cyclic device for user to climb thereon. A speed reducer is mounted on one of the two stands and connected to the second drive device to reducing the moving speed of the endless strap during operating.

Further benefits and advantages of the present invention will become apparent after a careful reading of the detailed description with appropriate reference to the accompanying drawings.

DETAILED DESCRIPTION OF THE INVENTION

Figure 1:
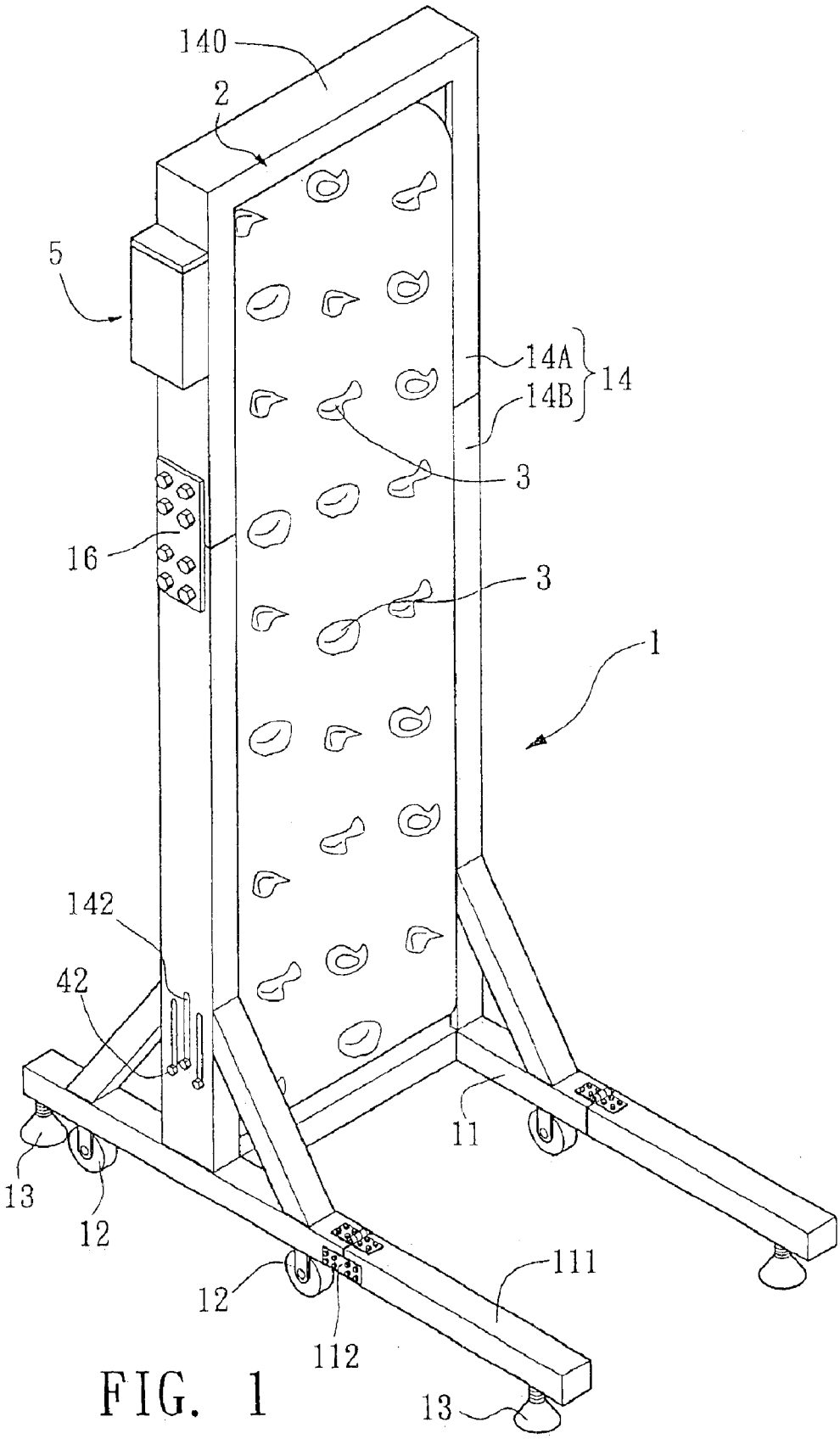
FIG. 1 is a perspective view of a rock climbing exerciser in accordance with the present invention.
Figure 2:
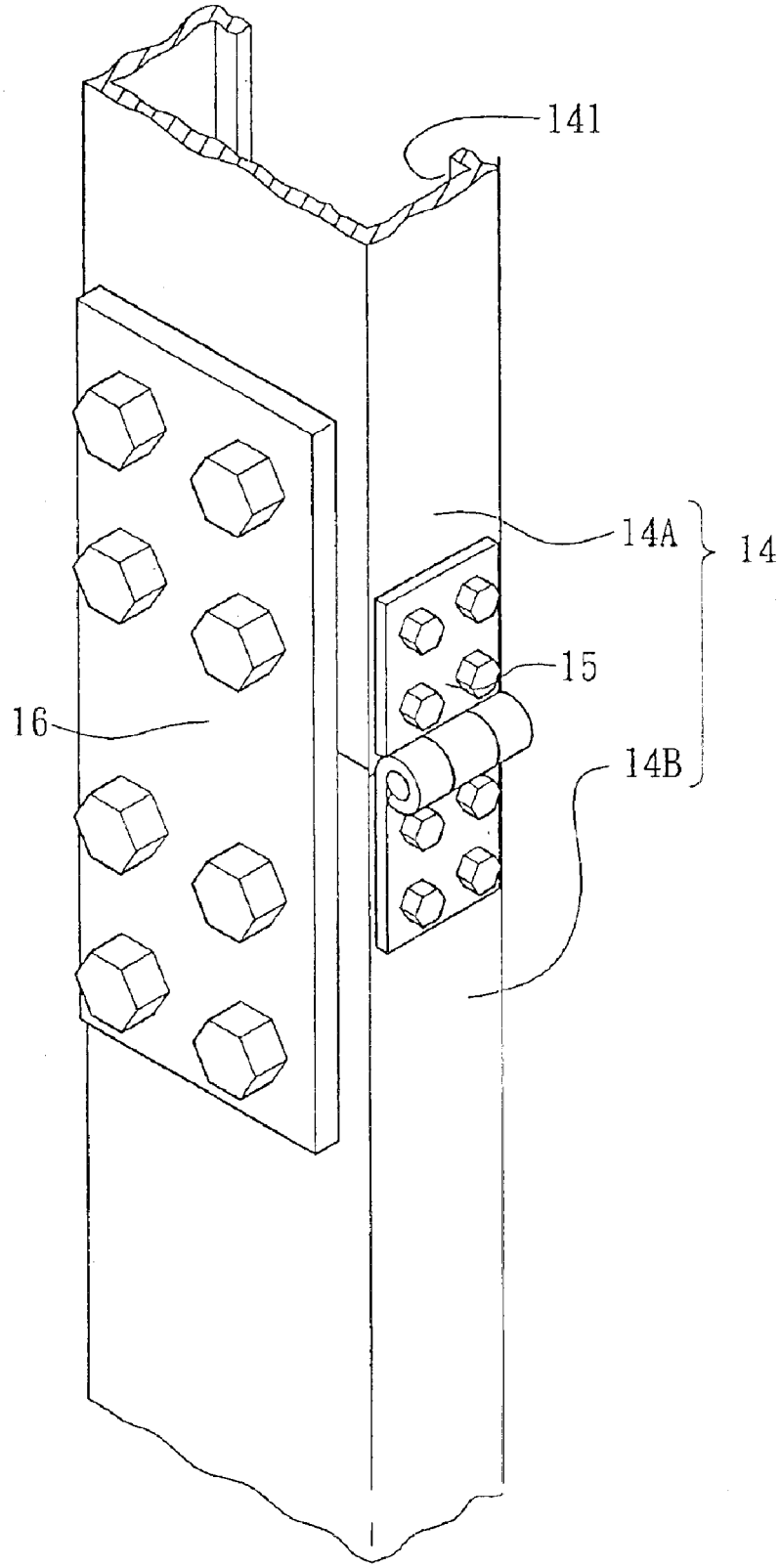
FIG. 2 is a partially enlarged perspective view of the rock climbing exerciser in FIG. 1 for showing the hinge.
Figure 3:
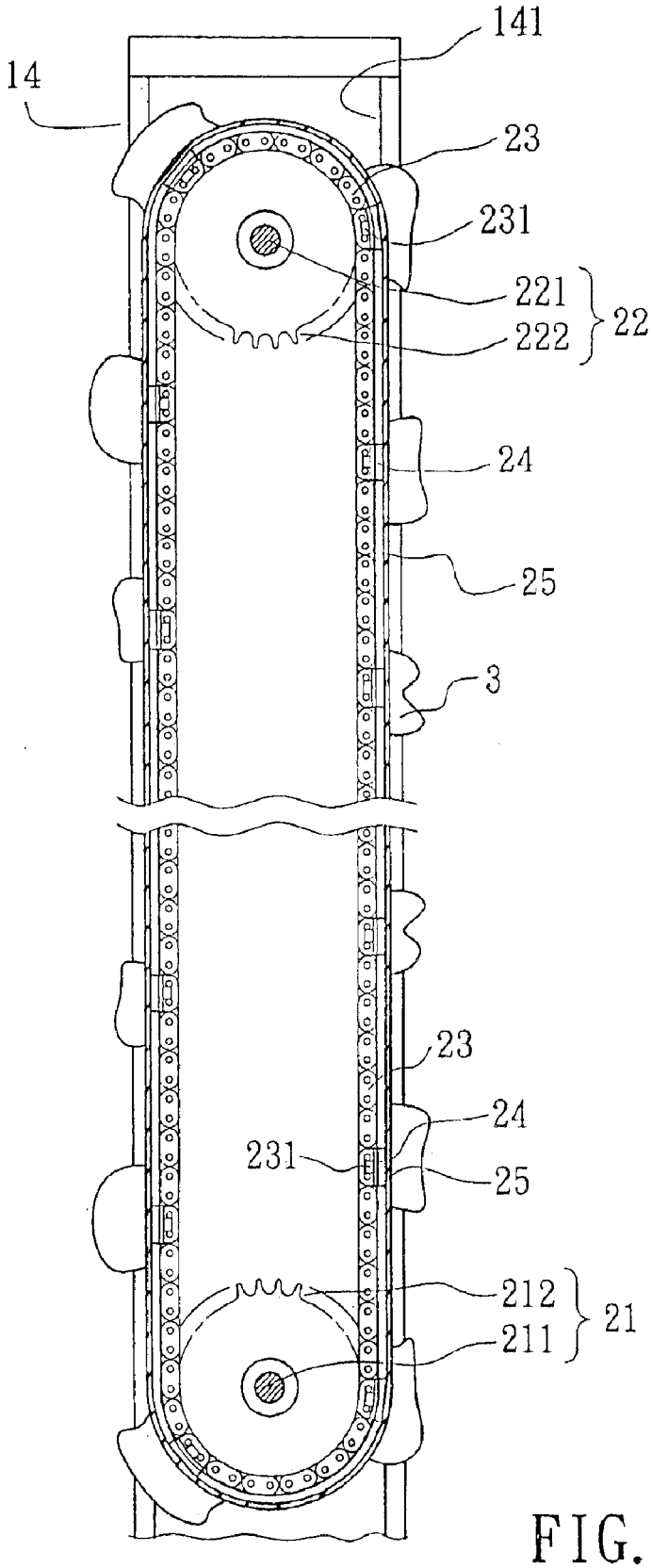
FIG. 3 is a side plan view of a cyclic device of the rock climbing exerciser of the present invention.
Figure 4:
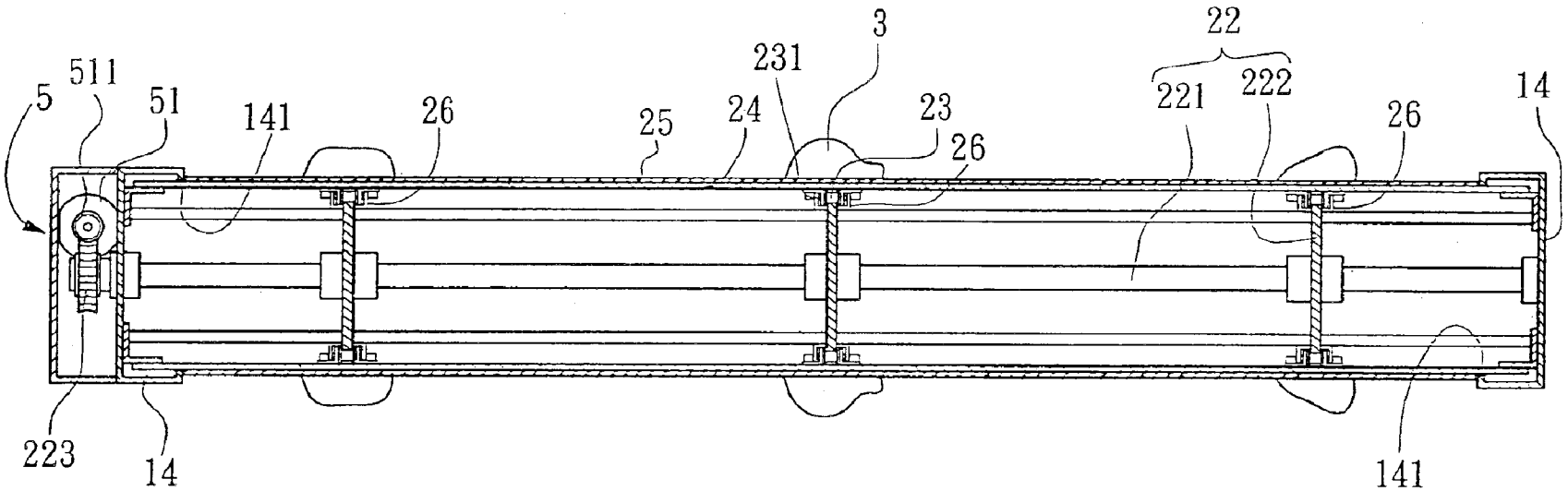
FIG. 4 is a top plan view of the rock climbing exerciser in FIG. 1 for showing the stand, the drive device, the chain and the U-shaped bracket.
Figure 5:
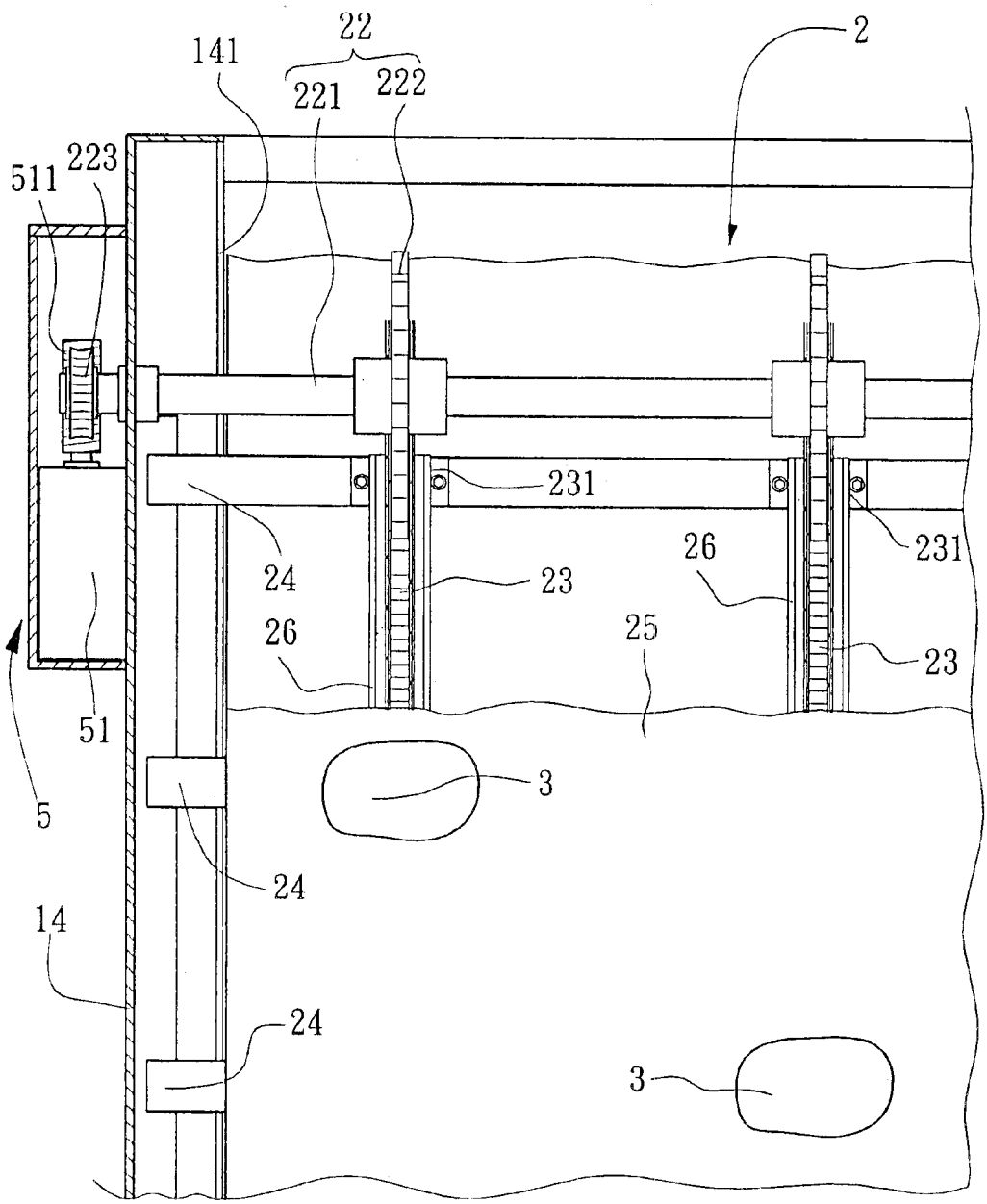
FIG. 5 is a partial front plan view of the rock climbing exerciser in FIG. 1 for showing the stand, the cyclic device and the speed reducer.
Figure 5A:
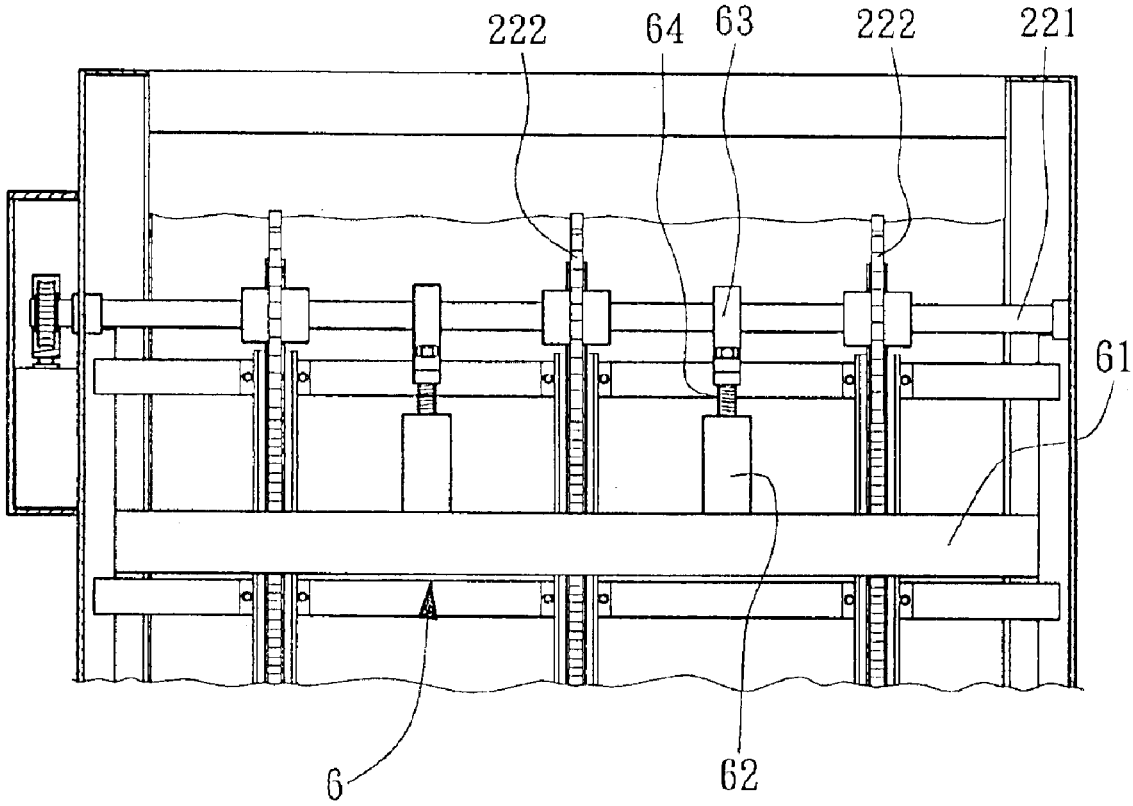
FIG. 5A is a partial front plan view of the rock climbing exerciser in FIG. 1 for showing a support device for the second shaft.
Figure 6:
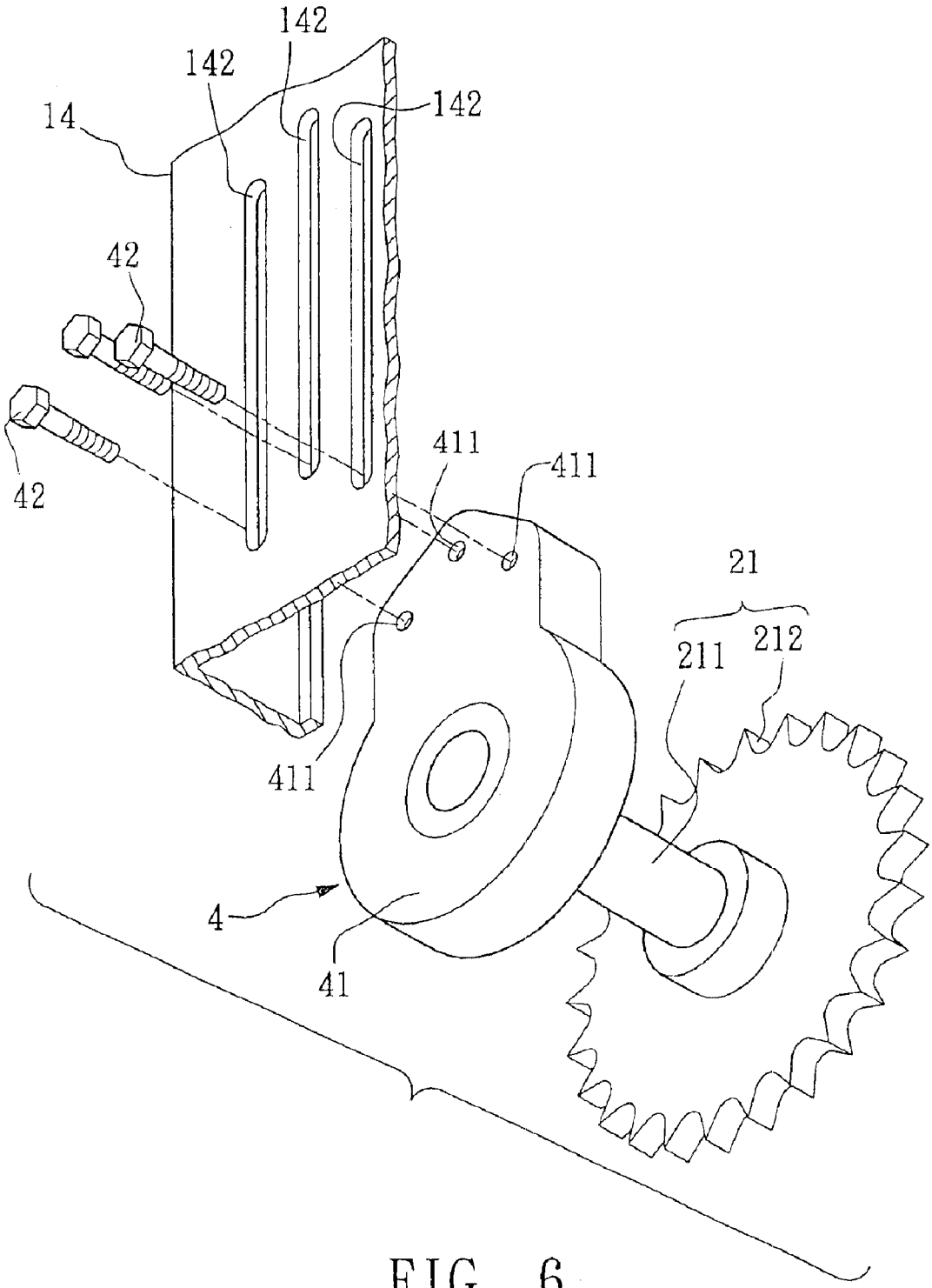
FIG. 6 is an exploded perspective of a chain adjust device of the rock climbing exerciser of the present invention.

Referring to the drawings and initially to FIGS. 1–6, a rock climbing exerciser in accordance with the present invention comprises a main frame (1), a cyclic device (2) mounted on the main frame (1), multiple grips (3) attached to an outer periphery of the cyclic device (2), a strain adjust device (4) laterally mounted to the main frame (1) and a speed reducer (5) laterally mounted to the main frame (1).

The main frame (1) includes a H-shaped base member (11) adapted to abut against a supporting surface and two foldable sections (111) pivotally connected to two opposite sides of the base member (11). The two foldable sections (111) are parallel to each other and in a same direction. Multiple rollers (12) are secured on a bottom of the base member (11) for user to easily move the present invention and multiple rubber stoppers (13) screwed onto the bottom of the base member (11) to stably support the present invention during operation. Two stands (14) are perpendicularly securely connected to two opposite sides of the base member (11) and a lateral rod (140) having two opposite ends each securely connected to a free end of the two stands (14). Each stand (14) has a lower section (14B) and an upper section (14A) longitudinally pivotally connected to the lower section (14B) by a hinge (15). A fastener (16) is laterally attached to an upper end of the lower section (14B) and the lower end of the upper section (14A) when the lower section (14B) and the upper section (14A) longitudinally correspond to each other. The stand (14) has a C-shaped cross-section and a channel (141) longitudinally defined in each stands (14). The two channels (141) of the stands (14) face each other.

The cyclic device (2) is mounted between the two stands (14). The cyclic device (2) includes a first drive device (21) laterally mounted to a lower portion of each of the two stands (14) and a second drive device (22) mounted to an upper portion of each of the stands (14). The first drive device (21) includes a first shaft (211) having two opposite ends respectively pivotally connected to a corresponding one of the two stands (14) and multiple first chain wheels (212) securely mounted to the first shaft (211) and spaced in equal intervals. The second drive device (22) includes a second shaft (221) having two opposite ends respectively pivotally connected to a corresponding one of the two stands (14) and multiple second chain wheels (222) securely mounted to the second shaft (221) and spaced in equal intervals. The number of the first chain wheels (212) is the same as the second chain wheels (222) and each first chain wheel (212) aligns with a corresponding one of the second wheels (222). A chain (23) is endlessly encircled the first chain wheel (212) and the second chain wheel (222) that align with each other so that the multiple first chain wheels (212) and the multiple second chain wheels (222) are synchronously operated. Each chain (23) includes multiple ears (231) outwardly extending therefrom at equal intervals. Each ear (231) of each of the chains (23) horizontally corresponds to that of the adjacent chain (23). A lateral panel (24) is mounted on the ears (231) that horizontally correspond to one another on the chains (23). An endless strap (25) are mounted around and secured on the lateral panels (24). Multiple grips (3) extend through the endless strap (25) and detachably mounted to the lateral panels (24) for user to hold and climb on the endless strap (25). Multiple U-shaped brackets (26) are mounted between the two stands (14) for receiving the chains (23) to prevent the lateral panels (24) and the chains (23) from being inward moved during operating.

The first shaft (211) of the first drive device (21) includes two opposite ends each having a strain adjust device (4) and the first shaft (211) is rotatable relative to each of the two strain adjust devices (4). Each stand (14) has multiple slots (142) defined in a lower portion of the lower section (14B) of each of the stands (14) and being parallel with one another. Each strain adjust device (4) includes a seat (41) having multiples threaded holes (411) defined therein and each aligning with a corresponding one of the multiple slots (142). As a result, a bolt (42) extends through a corresponding one of the slots (142) and is screwed into the aligning threaded hole (411) to hold the seat (41) in place. Consequently, the two strain adjust device (4) can be upwardly moved to release the strain or downward moved to gain the strain of the chains (23).

A speed reducer (5) is mounted on an upper portion of one of the stands (14) for reducing and adjusting the moving speed of the endless strap (25) during operating. The speed reducer (5) is connected to the second shaft (221) and the second shaft (221) is rotatably relative to the speed reducer (5).

In the preferred embodiment of the present invention, the speed reducer (5) includes a frequency conversion motor (51) mounted to the stand (14) and a worm (511) pivotally extending from the frequency conversion motor (51). The second shaft (221) includes one end extending through the stand (14) and having a worm gear (223) mounted on the second shaft (221). The worm gear (223) is engaged to the worm (511) of the frequency conversion motor (51) so that the operating speed of the endless strap (25) is controlled by the frequency conversion motor (51).

Figure 7:
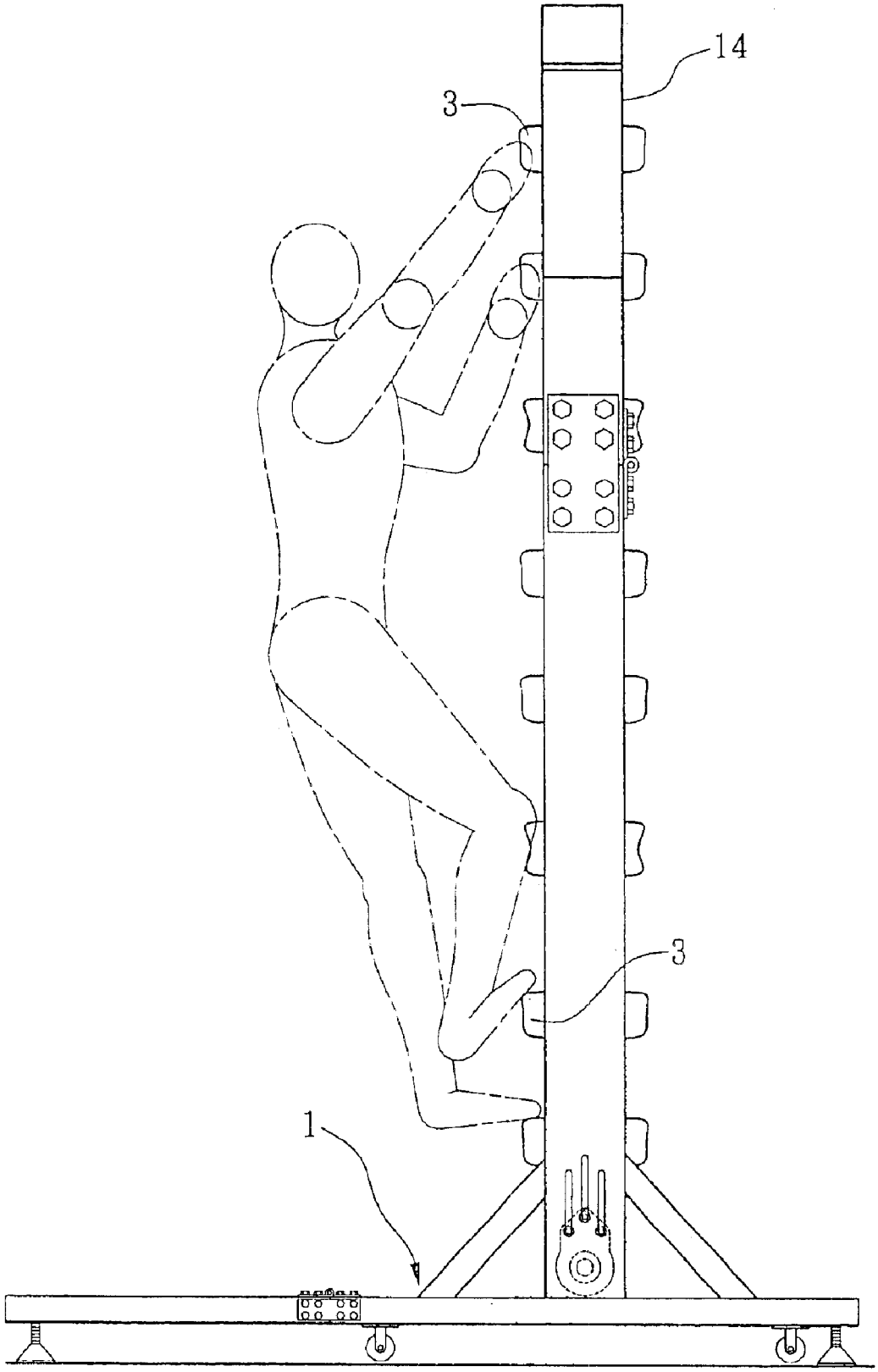
FIG. 7 is an operational side plan view of the rock climbing exerciser in accordance with the present invention.

With reference to FIG. 7, the multiple chains (23) are respectively coiled around the first drive device (21) and the second drive device (22) so that the endless strap (25) is cyclically operated. As regard to the speed reducer (5), the chains (23) and the first drive device (21) are not in a free condition due to the second drive device (22) that is connected to the speed reducer (5). Consequently, the user can adjust the moving speed of the endless strap (25) to correspond to the skill of the user by controlling the frequency conversion motor (51).

All the grips (3) are connected to the chains (23) via the lateral panels (24) so that the chains (23) load all the gravity from the operator. Consequently, the track structure of the conventional rock climbing exerciser is unnecessary to the present invention. The two opposite ends of each of the lateral panels (24) respectively extend into the two stands (14) so that the lateral panels (24) is limited by the stands (14) and do not forward moved during operating.

The grips (3) are detachably mounted to the lateral panels (24) so that the user can adjust the position of each of the grips (3) according to the purpose of the user.

The endless strap (25) of the present invention is made of soft material. Consequently, the endless strap (25) can provide a smooth touch to the user. In addition, the endless strap (25) covers the first drive device (21), the second drive device (22) and the chains (23) to prevent the user's extremities from being clamped due to the first drive device (21), the second drive device (22) and the chains (23).

The chains (23) load the gravity from the user and the lateral panels (24) are provided to mount the grips (3) so that the lateral panels (24) are arranged at intervals. In the preferred embodiment of the present invention, the distance between every two adjacent lateral panels (24) is set between 30 cm and 40 cm. Consequently, the total weight of the rock climbing exerciser of the present invention is greatly reduced for being more conveniently sued indoors.

Figure 8:
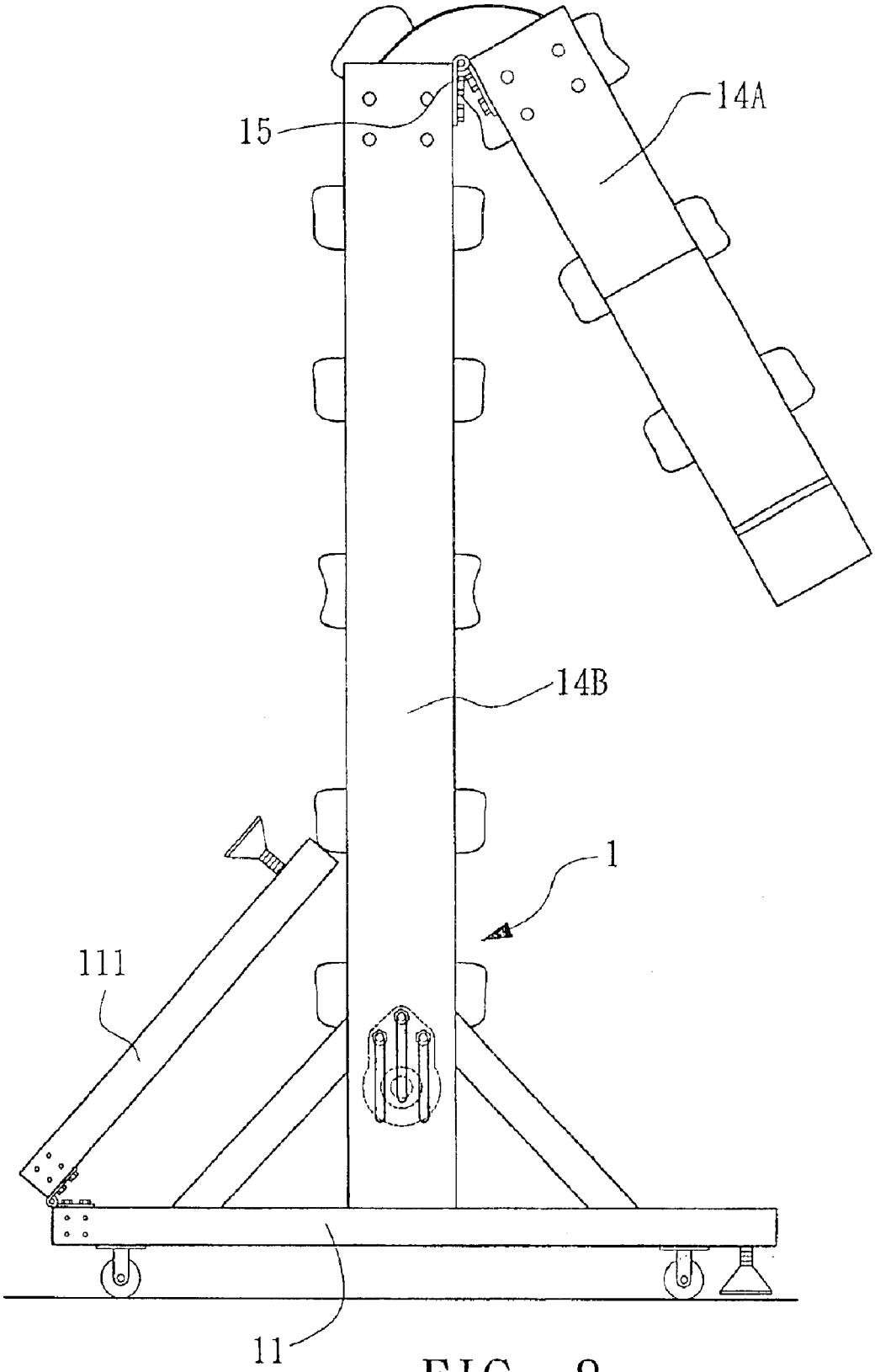
FIG. 8 is side plan view of the rock climbing exerciser in FIG. 1 when being folding.

With reference to FIG. 8, each stand (14) includes the upper section (14A) and the lower section (14B) that are pivotally connected to each other. Consequently, the stands (14) of the present invention can be folded for being easily stored. For folding the present invention, the bolts (42) are released and the fasteners (16) are detached from the two stands (14). Then, the upper section (14B) is downward circularly moved toward the lower section (14A) relative to the hinges (15) for reducing the total height of the present invention, and the strain adjust device (4) is upwardly moved relative to the stretched endless strap (25).

The rock climbing exerciser of the present invention further comprises a support device (6) horizontally mounted between the upper section (14A) of each of the two stands (14) for supporting the second drive device (22). The support device (6) includes a supporting rod (61) having two opposite ends respectively secured on the two stands (14) and corresponding to the second shaft (221). At least two columns (62) perpendicularly upwardly extend from the supporting rod (61) toward the second shaft (221). Each column (62) is located between two adjacent second chain wheels (222) and has a threaded rod (64) partially longitudinally screwed thereinto. A bearing (63) is secured on a free end of each of the threaded rod (64). Each bearing (63) co-axially corresponds to an axis of the second shaft (221) of the second drive device (22) after adjusting the height of each of the threaded rods (64).

Figure 9:
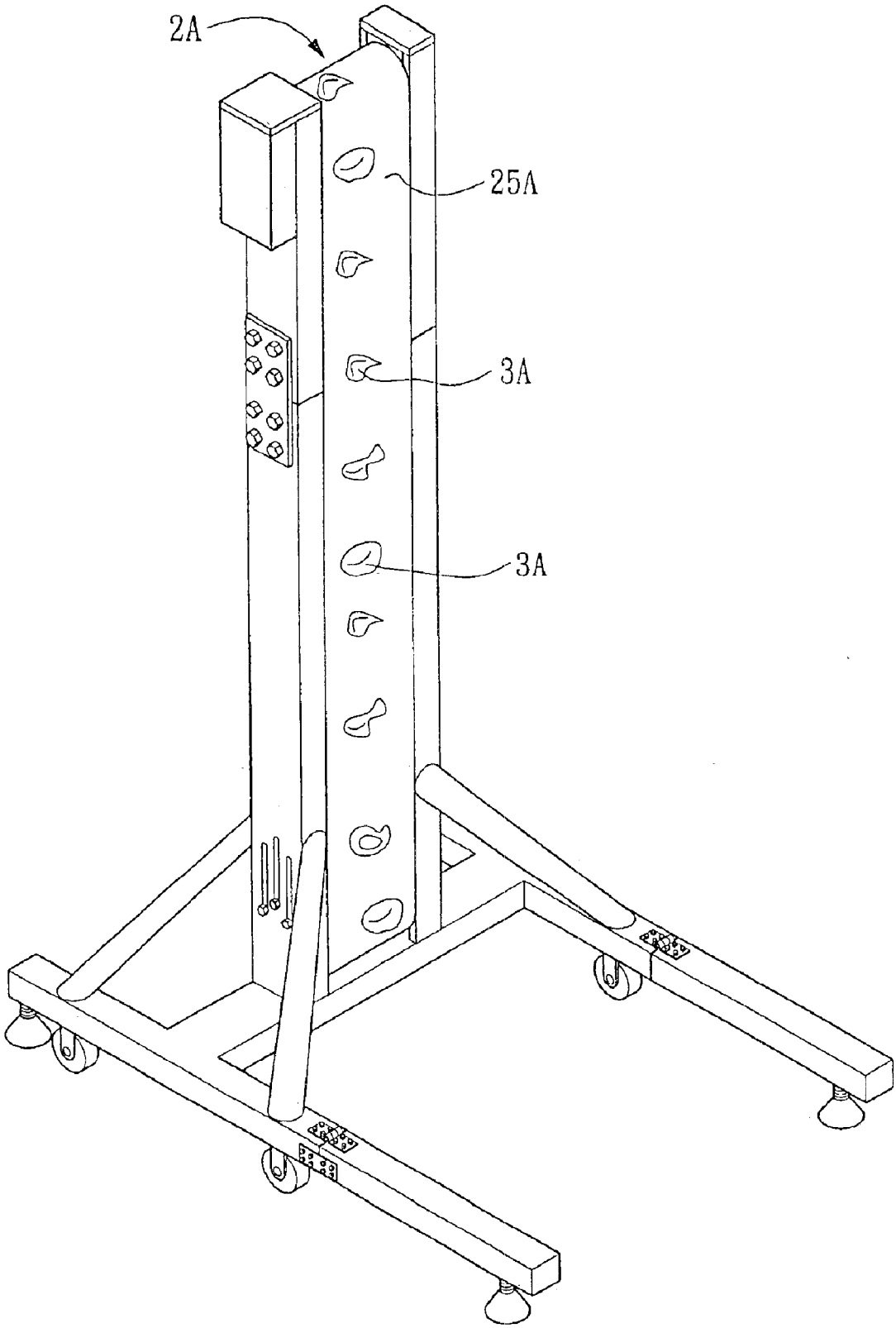
FIG. 9 is a perspective view of a second embodiment of the rock climbing exerciser in accordance with the present invention.
Figure 10:
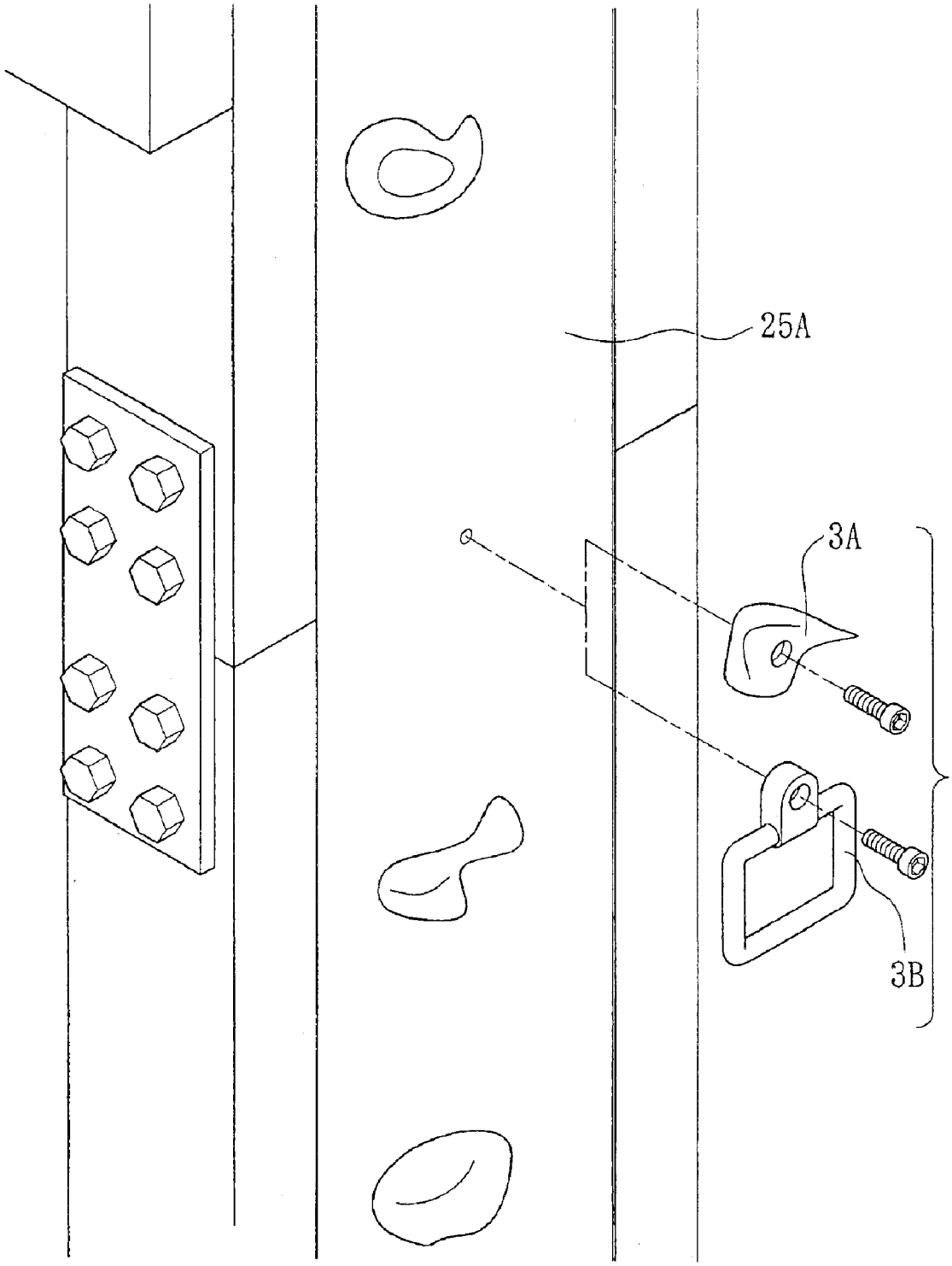
FIG. 10 is a partially perspective view of the rock climbing exerciser for showing the grip being replaced by a loop.

With reference to FIGS. 9 and 10 that show a second embodiment of the present invention, the cyclic device (2A) has only one pair of chain wheels (not shown) for mounting the endless strap (25A) and the grips (3A). For a newcomer, the grips (3A) may be replaced by loops (3B).

Figure 11:
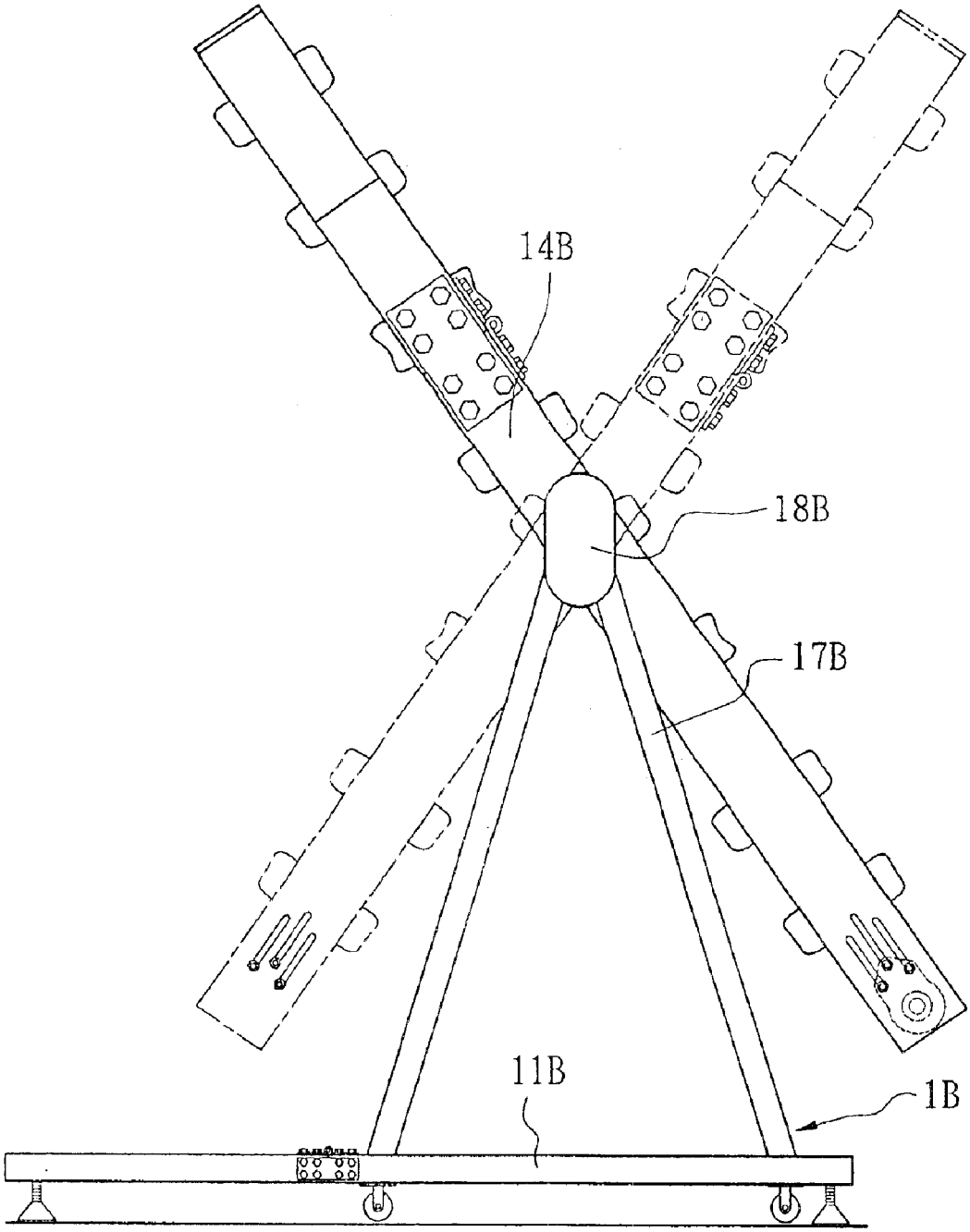
FIG. 11 is a side plan view of a third embodiment of the rock climbing exercise in accordance with the present invention in which the stand is pivotally mounted to the main frame.

With reference to FIG. 11 that shows a third embodiment of rock climbing exerciser of the present invention, the main frame (1B) includes a base member (11B) and two supporters (17B) respectively perpendicularly securely on two opposite sides of the base member (11B). An angle adjust device (18B) is mounted on a top of each of the two supporters (17B) and each stands (14B) has a middle portion selectively pivotally mounted to a corresponding one of the two angle adjust devices (18B). Consequently, the climbing angle of the present invention is adjustable for simulating various natural climbing environments.

Figure 12:
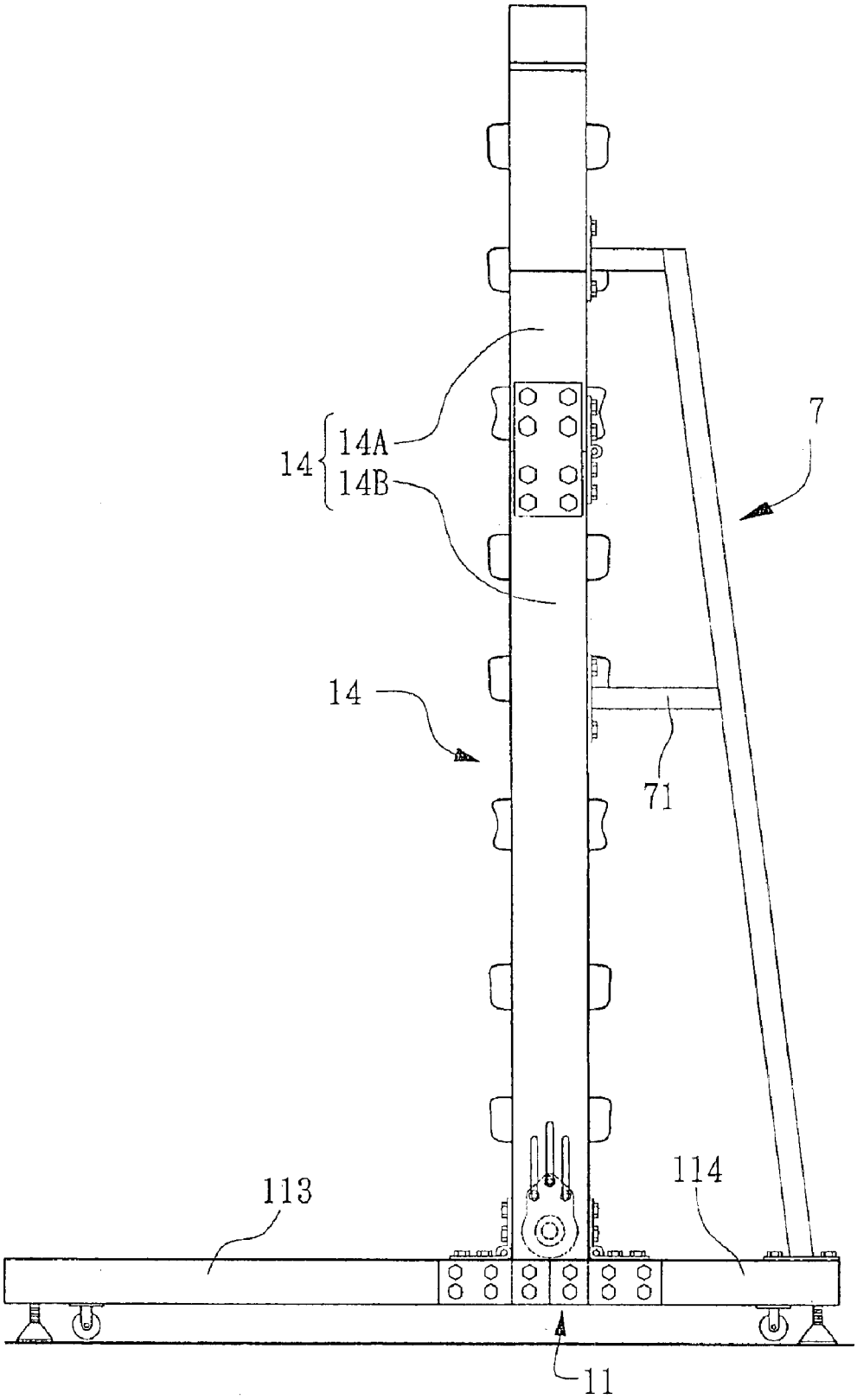
FIG. 12 is a side plan view of a fourth embodiment of the rock climbing exerciser in accordance with the present invention.

With reference to FIG. 12 that shows a fourth embodiment of the rock climbing exerciser of the present invention, the base member (11) includes a first pivot section (113) and a second pivot section (114) respectively pivotally connected to two opposite faces of each of the two stands (14) so that the first pivot section (113) and the second section (114) can be folded to abut the stands (14) for reducing the volume of the present invention when being stored. The rock climbing exerciser in accordance with the present invention further comprises two strengthening structures (7) respectively mounted on the two opposite sides of the main frame (1) for ensuring the stands (14) in a stable condition during operating. Each strengthening structure (7) includes two opposite ends respectively detachably secured on the upper section (14A) of each of the two stands (14) and a strengthening rod (71) laterally extending therefrom and detachably secured on the lower section (14B).

Although the invention has been explained in relation to its preferred embodiment, it is to be understood that many other possible modifications and variations can be made without departing from the spirit and scope of the invention as hereinafter claimed.

What is claimed is:

1. A rock climbing exerciser comprising:

a main frame including a base member adapted to abut against a supporting surface and two stands perpendicularly extending from the base member, each stand having a C-shaped cross-section and a channel longitudinally defined therein, the two channels of the two stands facing each other;

a cyclic device mounted between the two stands, the cyclic device includes a first drive device laterally mounted to a lower portion of each of the two stands and a second drive device laterally mounted to an upper section of the two stands, the first drive device including a first shaft having two opposite ends respectively pivotally connected to a corresponding one of the two stands and multiple first chain wheels securely mounted to the first shaft and spaced in equal intervals, the second drive device including a second shaft having two opposite ends respectively pivotally connected to a corresponding one of the two stands and multiple second chain wheels securely mounted to the second shaft and spaced in equal intervals, wherein the number of the first chain wheels is the same as the second chain wheels and each chain wheel aligns with a corresponding one of the second wheels, a chain endlessly encircled the first chain wheel and the second chain wheel that align with each other so that the multiple first chain wheels and the multiple second chain wheels are synchronously operated, each chain including multiple ears outwardly extending therefrom at equal intervals, each ear of each of the chains horizontally corresponding to that of the adjacent chain, a lateral panels mounted on the ears that horizontally correspond to one another on the chains, each lateral panel having two opposite ends respectively extending into the channels of the two stands, an endless strap mounted around and secured on the lateral panels for covering the first drive device and the second drive device, multiple grips extending through the endless strap and detachably mounted to the lateral panels for user to hold and climb on the endless strap, multiple U-shaped brackets mounted between the two stands for receiving the chains to prevent the lateral panels and the chains from being inward moved during operating; and a speed reducer connected to the cyclic device for reducing the moving speed of the endless strap for user to climb on the endless strap.

2. The rock climbing exerciser as claimed in claim 1, wherein the base member has a H-shape and two foldable sections being pivotal relative to the base member, the two foldable sections parallel to each other and in a same direction, a first fastener provided to secure the foldable section when the foldable section horizontally corresponds to the base member.

3. The rock climbing exerciser as claimed in claim 1, wherein the base member comprises multiple rollers secured on a bottom thereof for the user to easily move the rock climbing exerciser and multiple rubber stoppers screwed onto the bottom of the base member to stably support the base member during operation.

4. The rock climbing exerciser as claimed in claim 1, wherein each stand comprises a lower section perpendicularly connected to the base member and an upper section longitudinally pivotally connected to the lower section by a hinge, a second fastener attached to an upper end of the lower section and a lower end of the upper section when the lower section and the upper section longitudinally correspond to each other.

5. The rock climbing exerciser as claimed in claim 1, wherein the first shaft of the first drive device includes two opposite ends each having a strain adjust device mounted thereon and the first shaft is rotatable relative to each of the two strain adjust devices, each stand having multiple slots defined in a lower portion of the lower section of each of the two stands and being parallel with one another, each strain adjust device including a seat having multiple threaded holes defined therein and each aligning with a corresponding one of the multiple slots, a bolt extending through a corresponding one of the slots and screwed into the aligning threaded hole to hold the seat in place.

6. The rock climbing exerciser as claimed in claim 1, wherein the speed reducer includes a frequency conversion motor mounted to one of the two stands and a worm pivotally extending from the frequency conversion motor, the second shaft including one end extending through the stand and having a worm gear mounted thereon, the worm gear engaged with the worm of the frequency conversion motor so that the operating speed of the endless strap is controlled by the frequency conversion motor.

* * * * *